US007155873B2

(12) United States Patent
Palidis

(10) Patent No.: US 7,155,873 B2
(45) Date of Patent: Jan. 2, 2007

(54) STRUCTURAL CONNECTOR FOR A DRILLING RIG SUBSTRUCTURE

(75) Inventor: Anastasios Palidis, Katy, TX (US)

(73) Assignee: National Oilwell, L.P., Houston, TX (US)

( * ) Notice: Subject to any disclaimer, the term of this patent is extended or adjusted under 35 U.S.C. 154(b) by 45 days.

(21) Appl. No.: 10/822,353

(22) Filed: Apr. 12, 2004

(65) Prior Publication Data

US 2004/0206041 A1 Oct. 21, 2004

Related U.S. Application Data

(60) Provisional application No. 60/463,882, filed on Apr. 17, 2003.

(51) Int. Cl.
*E04C 5/00* (2006.01)

(52) U.S. Cl. ..... 52/702; 52/655.1; 52/741.1; 52/111; 211/182

(58) Field of Classification Search ..... 52/111, 52/112, 650.3, 651.11, 653.1, 655.1, 656.9, 52/651.1, 702, 741.1; 211/190, 191, 187, 211/182; 403/187, 230, 241; 5/296, 286, 5/282.1

See application file for complete search history.

(56) References Cited

U.S. PATENT DOCUMENTS 656,456 A * 8/1900 Harrison ..... 166/311
691,427 A * 1/1902 Williams ..... 5/296
744,194 A * 11/1903 Best ..... 52/651.1
792,366 A * 6/1905 Taylor ..... 5/132
795,947 A * 8/1905 Upton ..... 5/296
932,233 A * 8/1909 Adams ..... 5/296
1,090,955 A * 3/1914 Yorke ..... 403/170
2,962,170 A * 11/1960 Best ..... 211/182
3,150,617 A * 9/1964 Phillips ..... 108/193
4,831,795 A 5/1989 Sorokan ..... 52/120
5,062,733 A * 11/1991 Cholid et al. ..... 403/189
5,295,754 A * 3/1994 Kato ..... 403/174
5,438,811 A * 8/1995 Goya ..... 52/702
5,617,694 A * 4/1997 Baba ..... 52/712
5,845,453 A * 12/1998 Goya ..... 52/702
6,754,992 B1 * 6/2004 Byfield et al. ..... 52/36.5
6,802,169 B1 * 10/2004 Simmons ..... 52/648.1

OTHER PUBLICATIONS

International Search Report and Written Opinion, May 6, 2005, for foreign counterpart PCT application PCT/US04/11610.

* cited by examiner

*Primary Examiner*—Naoko Slack
*Assistant Examiner*—Jessica Laux
(74) *Attorney, Agent, or Firm*—Howrey LLP

(57) ABSTRACT

A method and apparatus for connecting sections of a drilling rig substructure is disclosed. The disclosed invention is a unique structural connector in which sections of a drilling rig substructure can be connected together without the use of pins or pin-type connectors. The structural connector of the present invention utilizes specially-shaped fixed members connected to, and extending through, support plates that are attached to sections of a drilling rig substructure that mate with specially-shaped mating lugs that are mounted on mating lug plates that are attached to separate sections of the drilling rig substructure. When the sections of the drilling rig substructure to be connected are positioned together, the specially-shaped mating lugs engage the specially-shaped fixed members and form a high strength structural connection between the sections of the drilling rig substructure.

16 Claims, 5 Drawing Sheets

STRUCTURAL CONNECTOR FOR A DRILLING RIG SUBSTRUCTURE

This application claims the benefit of U.S. Provisional Application No. 60/463,882 filed Apr. 17, 2003.

FIELD OF THE INVENTION

The present invention relates to a structural connector particularly useful in the oil and gas industry. In particular, the invention relates to a structural connector that allows for connection of elements of a drilling rig substructure in significantly less time and with less risk to rig personnel than previous pin-type connectors.

BACKGROUND OF THE INVENTION

In most land-based drilling operations, such as when drilling for oil and gas on land, it is necessary to transport a drilling rig to the site where the drilling operations will take place. Typically, these drilling rigs are very large and, thus, must be transported to the drilling site in several pieces. These rigs are transported in pieces that comprise the three main sections of a drilling rig: the substructure, the equipment floor, and the mast. Depending on the size of the drilling rig, the substructure, the equipment floor, and the mast may each be further broken down into multiple pieces for ease of transportation.

The equipment floor of the drilling rig is comprised of several segments, all of which, when assembled together, provide the platform or the "floor" for the drilling equipment and the mast that will be used in the drilling operations. The equipment floor may be constructed in a variety of ways, but is typically formed by using I-beams or box girders for the sides and interconnecting the sides with spreaders or other cross members. The equipment floor can, however, be constructed in any desired manner to achieve the necessary structural integrity and to provide the necessary support for the equipment used.

It has become the custom to use an equipment floor that is elevated above ground level in order to provide clearance for relatively tall blow-out prevention apparatus and other wellhead equipment used in drilling oil and gas wells. One embodiment of such an elevated-floor drilling rig structure is disclosed in U.S. Pat. No. 4,831,795 to Sorokan.

If an elevated equipment floor is used, the equipment floor is often connected to a collapsible elevating frame that, when assembled, can be raised—thereby raising the equipment floor above the ground. The collapsible elevating frame is part of the substructure and, like the equipment floor, this collapsible elevating frame is comprised of several pieces that must be transported to the drilling site.

Once the pieces of the drilling rig reach the site, the complete drilling rig must be reassembled so that drilling operations can commence. Assembling the drilling rig components on site, however, has proven to be a relatively complex and time consuming process. In many of the prior art drilling rig structures, the equipment floor and the substructure must be constructed and connected together in, essentially, a piece-by-piece operation.

Further, after assembling the various pieces of the equipment floor and the substructure, prior art drilling rig structures require drilling operators to "pin" the equipment floor and the substructure together using large pins that are capable of handling the significant forces and stresses that are imposed on the pinned connections. The process of pinning the equipment floor to the substructure requires the rig personnel to align pin holes in the sides of the equipment floor with pin holes in the sides of the substructure. Once the pin holes are aligned, it is necessary for one person to hold the pin in place while another person drives the pin through the pin holes with a sledge hammer or other device, thereby forming a connection between the equipment floor and the substructure. This process is repeated until all the pins connecting the equipment floor and the substructure are driven in place. Given the fact that the equipment floor and the substructure typically require in excess of twenty (20) pins to connect them together, the process of pinning these components together takes a significant amount of time. Ultimately, the significant amount of time required to assemble the drilling rig components increases the expense of using such a rig.

Moreover, the process of pinning these components together can be dangerous for the rig personnel performing such task. Specifically, the task of holding the pin connectors in place as they are driven through the pin holes with a sledge hammer or other device poses a significant risk of injury to the rig personnel performing such task.

Accordingly, what is needed is a structural connector capable of handling the significant forces and stresses required to hold the elements of the drilling rig together while at the same time allowing for easier connection and shorter assembly time. It is an object of the present invention to provide an apparatus and method for creating a structural connector capable of handling significant forces and stresses while providing for easy and efficient connection of structural components. Those and other objectives will become apparent to those of skill in the art from a review of the specification below.

SUMMARY OF THE INVENTION

A method and apparatus for providing a structural connection between components of a drilling rig is disclosed. The disclosed invention is a unique structural connector in which a section of the equipment floor of a drilling rig can be connected to the side boxes of the drilling rig substructure without the use of pins or other prior art connectors. The structural connector of the present invention utilizes specially-shaped fixed support members connected to, and extending through, support plates attached to the side boxes of the substructure to mate with specially-shaped mating lugs that are mounted on mating lug plates attached to the equipment floor of the drilling rig. The fixed support members are designed with contoured tops and substantially vertical walls that mate with similarly shaped notches in the mating lugs attached to the mating lug plates.

When the equipment floor is lowered into place between the side boxes of the substructure, the specially-shaped mating lugs engage the specially-shaped fixed support members and form a structural connection between the equipment floor and the side boxes of the substructure. The result is a high strength structural connector that allows for easier and more efficient connection of structural components.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention. Moreover, although the present invention is discussed in the following paragraphs by reference to connecting a section of an equipment floor of a drilling rig to the side boxes of the rig, it will be apparent from the present disclosure that the structural connector of the present invention can be utilized to connect various structural members together and should not be limited to connecting together components of a drilling rig.

Figure 1:
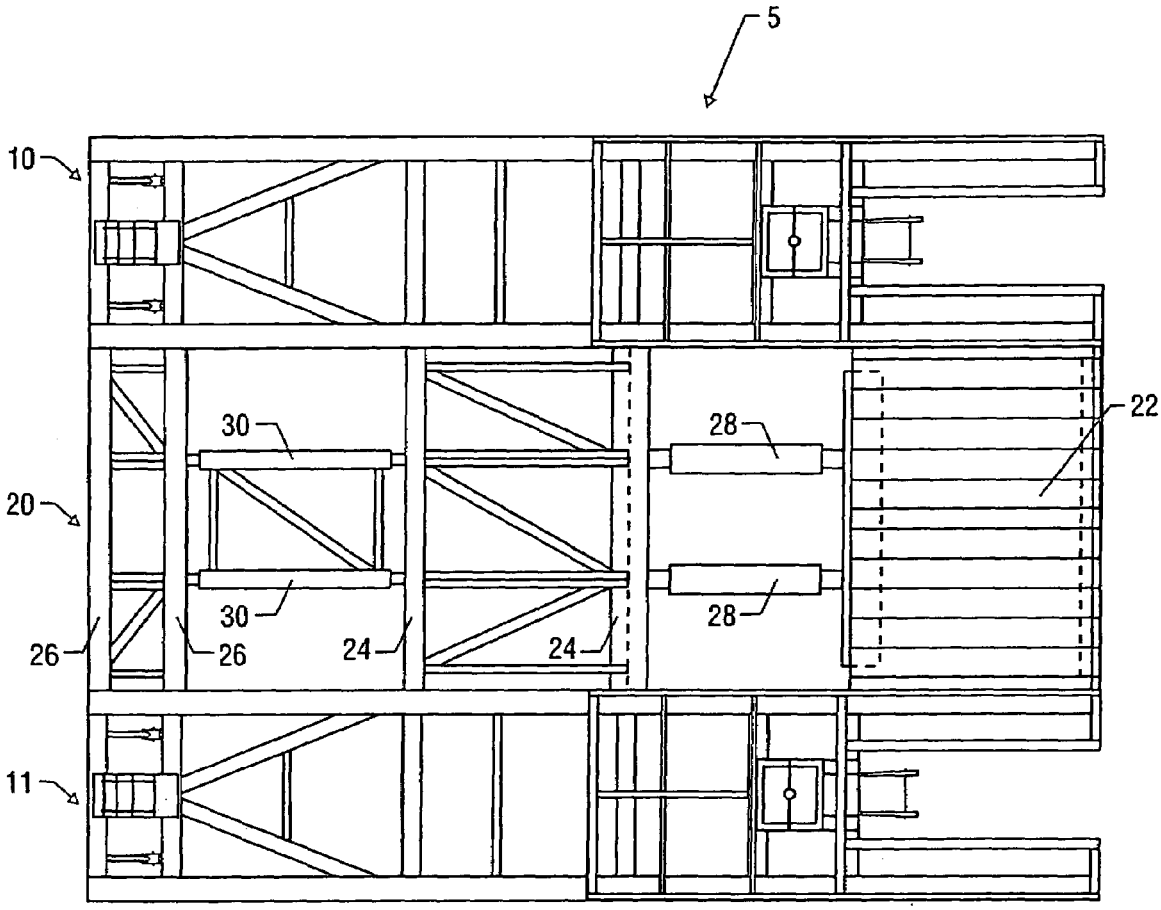
FIG. 1 is a top view of the substructure of a typical elevated floor drilling rig showing the various components of the substructure.

Referring to FIG. 1, various components of the substructure 5 of a typical elevated-floor drilling rig are shown. The substructure shown in FIG. 1 consists of three main components: side box 10, unitized equipment floor 20, and side box 11. The unitized equipment floor 20 is referred to as "unitized" in that the various spreader assemblies that comprise the structural components of this section of the drill floor are connected together to form a one piece—or "unitized"—section of drill floor. These structural components consist of a setback spreader assembly 22, a drawworks spreader assembly 24, a rear spreader assembly 26, rotary beams 28, and tie beam spreaders 30.

In utilizing a unitized equipment floor 20, it is not necessary to perform the extra steps of connecting together each individual component of the equipment floor at the well site. The elimination of these steps results in a significant reduction in time spent assembling the drilling rig at the well site. The present invention is not, however, limited to use with only a unitized equipment floor. One of skill in the art will recognize that time savings are still achieved even if the structural connector of the present invention is attached to a portion of an equipment floor that is not unitized.

Figure 2:
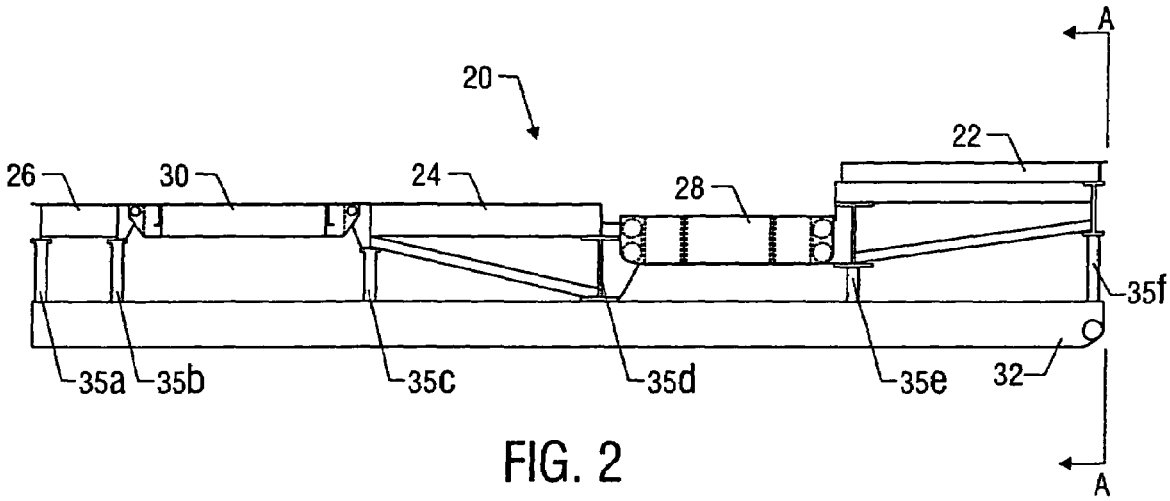
FIG. 2 is a side elevation view of a unitized equipment floor of a typical elevated drilling rig structure showing the various structural components of the equipment floor.

FIG. 2 shows a side elevation view of the unitized equipment floor 20 shown in FIG. 1. FIG. 2 shows the components of the unitized equipment floor 20 connected together to form the structural support "frame" for the center portion of the rig floor of a typical drilling rig. In prior art drilling rigs, the unitized equipment floor 20, or, if no unitized assembly is used, the individual structural components of the spreader assemblies, must be "pinned" to the side boxes 10 and 11 in multiple locations. As shown in FIG. 2, six pin connection points—designated 35*a* through 35*f*—are utilized along each side of the unitized equipment floor 20. As such, for the unitized equipment floor 20 shown in FIG. 2, a total of twelve pin connection points are utilized to connect the unitized equipment floor 20 to the side boxes 10 and 11 of the substructure 5. One of skill in the art will recognize that depending on the size and weight of the unitized equipment floor 20, the number of pin connection points may be greater than or less than the twelve connection points shown in FIG. 2.

In addition, the significant forces and stresses imposed on the pins connecting the unitized equipment floor 20 to the side boxes 10 and 11 of the substructure 5 typically require the use of two pins at each of the twelve pin connection points shown in FIG. 2—for a total of twenty-four pins. As noted above, the number of pin connection points may vary according to the size and weight of the unitized equipment floor 20 and, thus, the number of pins may vary accordingly. With larger rigs, the number of pin connection points and pins used to connect the unitized equipment floor 20 to the side boxes 10 and 11 of the substructure 5 can be substantial. As the number of pins increases, the amount of time required to assemble the drilling rig at the drill site increases. The structural connector of the present invention eliminates the pin-type connections of prior art drilling rigs and, thus, substantially reduces the amount of time required to assemble a drilling rig at the drill site.

Figure 2A:
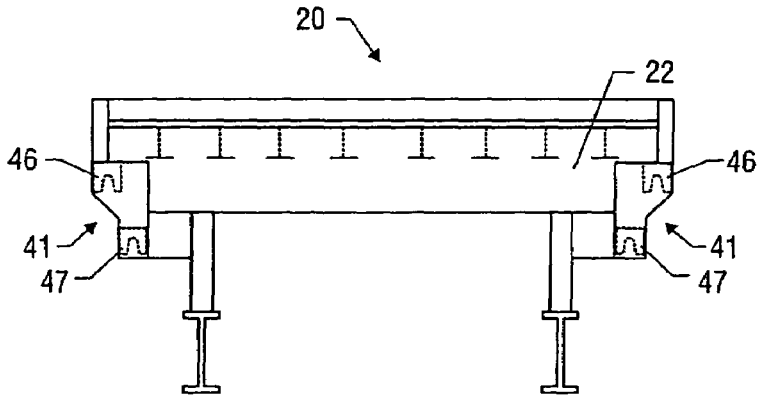
FIG. 2*a* is a front elevation view of the unitized equipment floor shown in FIG. 2 in the direction of line A—A.

FIG. 2*a* shows a front elevation view of the unitized equipment floor 20 shown in FIG. 2. As can be seen in FIG. 2*a*, mating lugs assemblies 41 have been connected to the setback spreader assembly 22 of the unitized equipment floor 20 (such connection point corresponding to connection point 35f shown in FIG. 2). The mating lugs assemblies 41 can be connected to the setback spreader assembly 22 through any suitable metal-to-metal connection method capable of handling the significant forces and stresses imposed on the mating lugs assemblies 40 and 41. In the preferred embodiment of the present invention, the mating lugs assemblies 41 are welded to the setback spreader assembly 22. In a similar fashion, additional mating lugs assemblies 41 can be attached to the unitized equipment floor 20 at each of the connection points designated 35*a* through 35*e* in FIG. 2.

Figure 3:
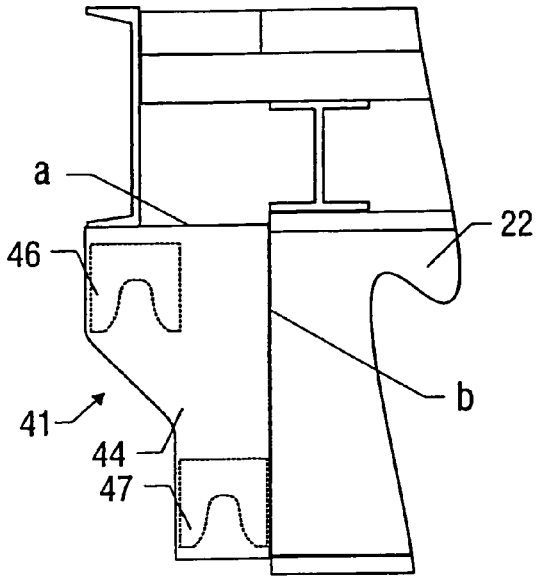
FIG. 3 is a side view of the mating lugs assembly with saddle-shaped mating lugs attached thereto according to one embodiment of the present invention.

FIG. 3 is an enlarged side view of the mating lugs assembly 41 shown in FIG. 2*a*. In the preferred embodiment, the mating lugs assembly 41 is attached to the setback spreader assembly 22 along the entire length of the connection points a and b shown in FIG. 3. In the preferred embodiment of the present invention, the mating lugs assembly 41 is welded in place at connection points a and b.

FIG. 3 shows mating lug 46 and mating lug 47 attached to mating lugs assembly 41, as discussed in more detail below with reference to FIGS. 3*a* and 3*b*. FIG. 3 also shows the unique "saddle" shape of mating lug 46 and mating lug 47. The shape of mating lugs 46 and 47 is shown in more detail in FIG. 3*b*, discussed below.

Figure 3A:
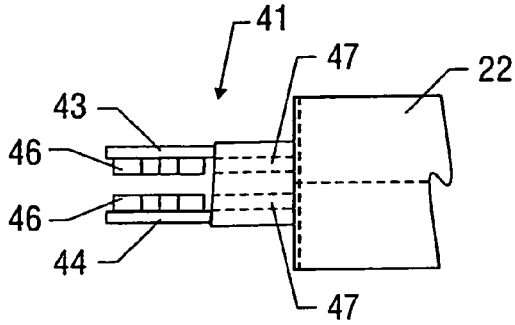
FIG. 3*a* is a top view of the mating lugs assembly shown in FIG. 3.
Figure 3B:
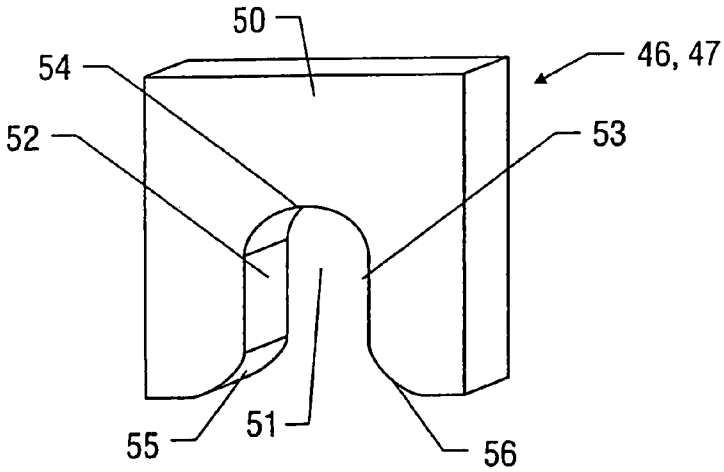
FIG. 3*b* is a detailed view of the saddle-shaped mating lugs shown in FIGS. 3 and 3*a*.

FIG. 3*a* is a top view of the mating lugs assembly 41 attached to the setback spreader assembly 22 as shown in FIG. 3. As can be seen in FIG. 3*a*, mating lugs assembly 41 preferably consists of two metal "plates," mating lug plate 43 and mating lug plate 44, separated by a short distance. Mating lug plate 43 and mating lug plate 44 each have two mating lugs, mating lug 46 and mating lug 47, attached to their inside plate surface. Thus, the structural connector of one embodiment of the present invention utilizes four mating lugs at each mating lugs assembly. In the preferred embodiment of the present invention, mating lugs 46 and 47 are welded to the inside surfaces of mating lug plates 43 and 44. One of skill in the art will recognize that mating lugs 46 and 47 can be attached to mating lug plates 43 and 44 by any suitable metal-to-metal connection method that is capable of handling the significant forces and stresses imposed on the mating plates and mating lugs.

Further, in an alternative embodiment of the present invention, the unique shape of the support notch of the mating lugs 46 and 47 may be cut into mating lug plates 43 and 44 in lieu of attaching mating lugs 46 and 47 to the surfaces of mating lug plates 43 and 44. Cutting the unique shape of the support notch of the mating lugs 46 and 47 into mating lug plates 43 and 44 can be used for smaller drilling rigs with lighter equipment floors, as cutting material out of mating lug plates 43 and 44 may reduce the load handling capability of the plates.

Mating lug 46 and mating lug 47 are specially shaped to achieve the objectives of the present invention. As shown in detail in FIG. 3*b*, mating lugs 46 and 47 each consist of a square or rectangular metal piece 50 with a uniquely shaped support notch 51. Support notch 51 is specially shaped to have vertical, or substantially vertical, side walls 52 and 53 and a contoured top surface 54. Additionally, support notch 51 is shaped with tapered guide surfaces 55 and 56 at the entry point of the support notch 51. As discussed with reference to FIGS. 4–4*b*, the unique shape of support notch 51 is specially designed to mate with the uniquely shaped fixed support members in accordance with the present invention.

Mating lug plates 43 and 44 are specifically shaped such that mating lugs 46 and 47 can be attached to the plates at locations that allow for unhindered access to the support notch 51 of both mating lugs 46 and 47. Specifically, as shown in FIG. 3, mating lug 47 is attached to mating lug plate 44 at a location that is lower than the attachment point for mating lug 46 and closer to setback spreader assembly 22. Conversely, mating lug 46 is attached to mating lug plate 44 at a higher location than the attachment point for mating lug 47 and further from setback spreader assembly 22. Similarly, as shown in FIG. 3*a*, a second set of mating lugs 46 and 47 is attached to mating lug plate 43 at the same locations. As discussed in reference to FIGS. 5 and 5*a* below, this configuration allows mating lugs 46 and 47 on mating lug plates 43 and 44 to mate with the fixed support members of the support plate attached to the side boxes of the substructure to form the structural connector of the present invention.

Figure 4:
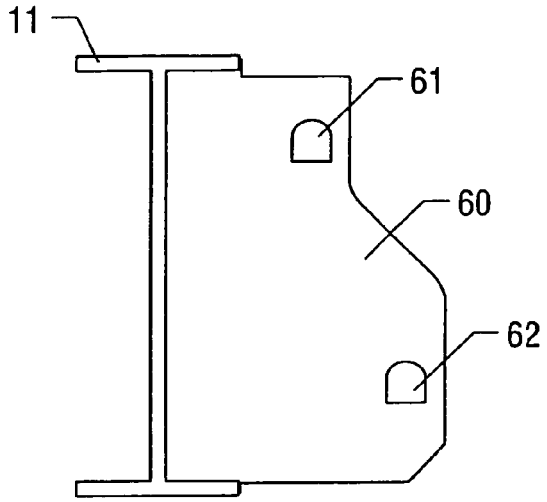
FIG. 4 is a side view of the support plate with fixed support members extending through the plate according to one embodiment of the present invention.

Referring now to FIG. 4, the support plate 60 of a preferred embodiment of the present invention is shown. As can be seen in FIG. 4, support plate 60 is attached to side box 11 of the drilling rig substructure 5 (as designated in FIG. 1). Support plate 60 is attached to side box 11 at a location aligned with connection point 35*f* such that it can mate with the corresponding mating lugs assembly 41 attached to the unitized equipment floor 20 at connection point 35*f*. Support plate 60 can be connected to the side box 11 of the substructure through any suitable metal-to-metal connection method capable of handling the significant forces and stresses imposed on the support plate 60. In the preferred embodiment of the present invention, the support plate 60 is welded to the side box 11. In a similar fashion, additional support plates 60 can be attached to side box 11 at locations that are aligned with each of the connection points designated 35*a* through 35*e* in FIG. 2 such that the support plates 60 can mate with the mating lugs assemblies 41.

Figure 4A:
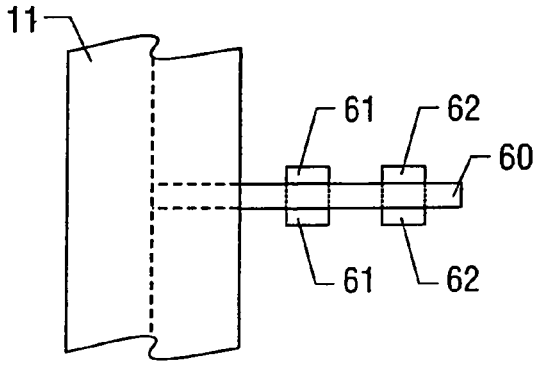
FIG. 4*a* is a top view of the support plate shown in FIG. 4 showing the fixed support members extending out from both sides of the plate according to one embodiment of the present invention.

In accordance with the preferred embodiment of the present invention, fixed support member 61 and fixed support member 62 are attached to and extend outwardly from both sides of support plate 60. FIG. 4*a* is a top view of the support plate 60 connected to side box 11. FIG. 4*a* shows fixed support members 61 and 62 extending outwardly from both sides of the support plate 60. In the preferred embodiment of the present invention, fixed support members 61 and 62 extend outwardly from the sides of support plate 60 approximately 1–2 inches. The above range of distance is given by way of example only. One of skill in the art will recognize that the distance fixed support members 61 and 62 extend out from the sides of support plate 60 can vary significantly depending on several factors, including, but not limited to, the loads imposed on the support plate and fixed support members, the size of the fixed support members themselves, the size of the support plate, and the materials used to make the support members and the support plate.

Figure 4B:
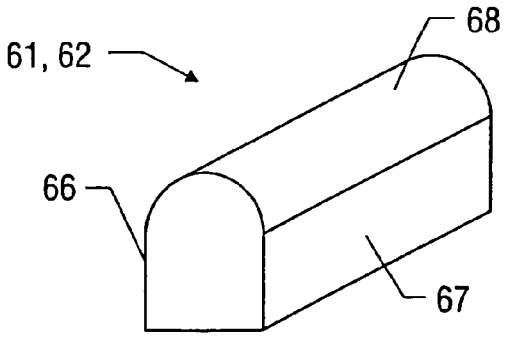
FIG. 4*b* is a detailed view of the fixed support members shown in FIGS. 4 and 4*a*.

The fixed support members 61 and 62 are shown in more detail in FIG. 4*b*. As can be seen in FIG. 4*b*, the fixed support members 61 and 62 are specially shaped to have vertical, or substantially vertical, side walls 66 and 67 and a contoured top surface 68. The shape and size of fixed support members 61 and 62 are specifically designed to mate with the support notch 51 shown in FIG. 3*b*. According to one embodiment of the present invention, the fixed support members 61 and 62 can be attached to the support plate 60 by cutting a hole in the support plate 60 to correspond to the shape and size of the fixed support members 61 and 62, passing the fixed support members 61 and 62 through such hole, and then welding the fixed support members 61 and 62 in place. It will be appreciated by one of skill in the art that fixed support members 61 and 62 can be attached to support plate 60 by any suitable metal-to-metal connection method that is capable of handling the significant forces and stresses imposed on the support plate and fixed support members.

In addition, support plate 60 is specifically shaped to allow fixed support members 61 and 62 to be attached at locations on the support plate 60 such that they can engage support notches 51 of both mating lugs 46 and 47 to form the structural connector of the present invention. Specifically, as shown in FIG. 4, fixed support member 62 is attached to support plate 60 at a location that is lower than the attachment point for fixed support member 61 and further away from side box 11. Conversely, fixed support member 61 is attached to support plate 60 at a higher location than the attachment point for fixed support member 62 and closer to side box 11. As discussed in reference to FIGS. 5 and 5*a* below, this configuration allows fixed support members 61 and 62 to mate with the mating lugs on the mating lugs assembly to form the structural connector of the present invention.

Figure 5:
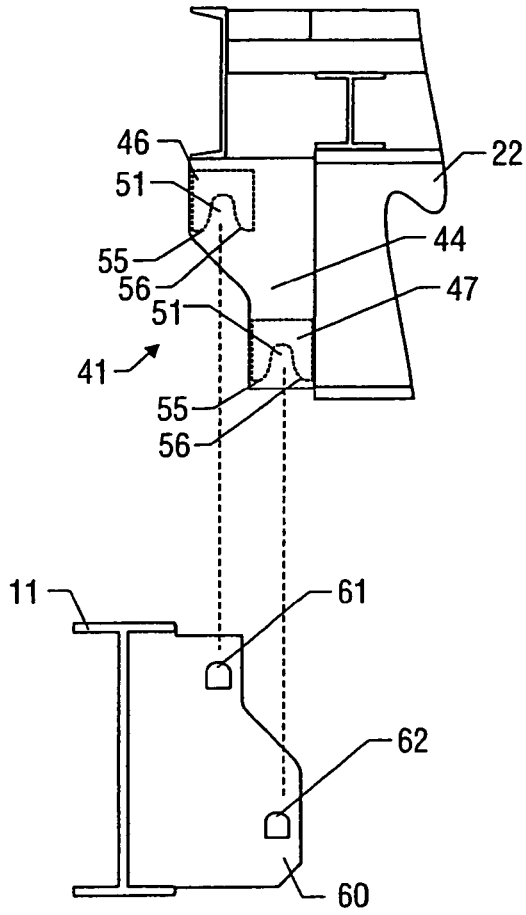
FIG. 5 is a side view showing the support plate of FIG. 4 aligned to receive the mating lugs assembly of FIG. 3 to form a structural connector according to one embodiment of the present invention.

Having described the individual elements of the structural connector of the present invention, the completed structural connector will be described with reference to FIGS. 5 and 5*a*. In FIG. 5, the elements of the disclosed structural connector are shown vertically aligned such that the connection can be made up. Specifically, when the drilling rig is being assembled at the drilling site, the side boxes of the substructure will be placed on the ground and positioned in such a way that the unitized equipment floor can be lowered into place and connected to the side boxes. As shown in FIG. 5, the mating lugs assembly 41 attached to the setback spreader assembly 22 is aligned above the support plate 60 attached to the side box 11 of the substructure. The mating lugs assembly 41 is aligned such that the support notches 51 in mating lugs 46 and 47 attached to mating lug plate 44 can be lowered into a mating position with fixed support members 61 and 62 on one side of the support plate 60. In a similar fashion, the support notches 51 of mating lugs 46 and 47 attached to mating lug plate 43 are mated with fixed support members 61 and 62 on the opposite side of the support plate 60. The tapered guide surfaces 55 and 56 of the support notches 51 act as a "guide" that guides the mating lugs 46 and 47 into engagement with the fixed support members 61 and 62. The use of tapered guide surfaces 55 and 56 further increases the efficiency with which the structural connector of the present invention can be made up.

Figure 5A:
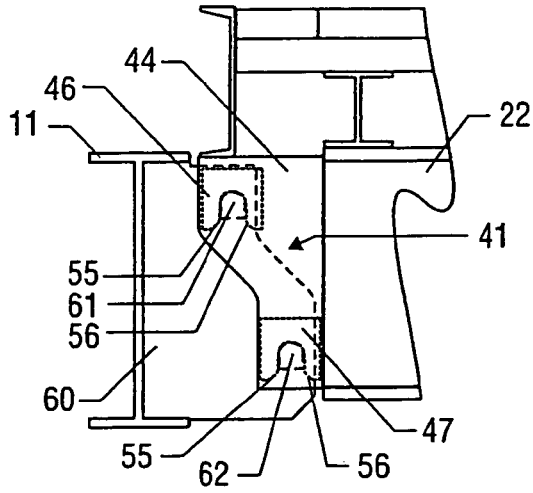
FIG. 5*a* is a side view of the mating lugs assembly of FIG. 3 connected with the support plate of FIG. 4 to form a structural connector according to one embodiment of the present invention.

When so connected, the mating lug plates 43 and 44 of the mating lugs assembly 41 are on either side of the support plate 60 as shown in FIG. 5*a*. In this configuration, the ends of fixed support members 61 and 62 extending outwardly on both sides of support plate 60 fit tightly within the corresponding notches 51 of mating lugs 46 and 47 attached to mating plates 43 and 44. As such, the structural connector of the preferred embodiment of the present invention comprises a four point connection in which the ends of fixed support member 61 engage the two support notches 51 of the two mating lugs 46 attached to mating lug plates 43 and 44, and the ends of fixed support member 62 engage the two support notches 51 of the two mating lugs 47 attached to mating lug plates 43 and 44.

For larger drilling rigs, alternative embodiments of the present invention utilizing multiple support plates and additional mating lug plates can be used. For example, in one alternative embodiment, the structural connector may utilize two support plates—with each plate having two fixed support members extending therethrough—and a mating lugs assembly consisting of three mating plates. In such a configuration, the structural connector would comprise an eight point connection in the manner described above with reference to the preferred embodiment. In a like fashion, the number of support plates and number of mating plates used in another embodiment of the structural connector could be increased to three and four respectively to create an even stronger connection. One of skill in the art will recognize that numerous alternative embodiments of the present invention can be made by adding additional support plates and additional mating lug plates to the structural connector to increase the load handling capability of the connection.

Similarly, one of skill in the art will recognize that numerous alternative embodiments of the present invention can be made by increasing the number of mating lugs attached to the mating lug plates and by increasing the number of corresponding fixed support members attached to the support plates. One of skill in the art will also recognize that numerous alternative embodiments of the present invention exist in which the number of mating lugs and fixed support members used in the structural connector can be increased at the same time the number of support plates and mating lug plates is increased. Further, one of skill in the art will recognize that, for connections handling smaller loads, the number of mating lugs attached to the mating lug plates and the number of corresponding fixed support members attached to the support plates can be reduced to one. Likewise, for smaller load applications, mating lugs assemblies having a single mating lug plate can be utilized.

In yet another alternative embodiment of the present invention, the location of the support plates and the location of the mating lugs assemblies can be reversed, i.e., the support plates can be attached to the unitized equipment floor (instead of the side boxes), and the mating lugs assemblies can be attached to the side boxes (instead of the unitized equipment floor). In such a configuration, the contoured tops of the fixed support members would face downward (in the direction of the ground) such that they could mate with upward facing mating lugs—with the opening of the support notch in the mating lugs facing upwardly.

The result of the mating of the support notches 51 of the mating lugs 46 and 47 with the fixed support members 61 and 62—as shown in FIG. 5*a*—is a structural connector capable of handling the significant vertical forces imposed on the connection by the weight of the unitized equipment floor and the significant moment imposed on the connection by horizontal forces acting on the connection. The ability of the structural connector of the present invention to handle these significant forces and stresses is derived from the uniquely shaped support notches 51 (shown in detail in FIG. 3*b*) and uniquely shaped fixed support members 61 and 62 (shown in detail in FIG. 4*b*). Specifically, when the contoured tops 68 of the fixed support members 61 and 62 are engaged with the contoured top surface 54 of the support notch 51 of the mating lugs 46 and 47, the vertical load caused by the weight of the unitized equipment floor is spread evenly over the entire contoured tops 68 such that the vertical load can be effectively carried by the fixed support members 61 and 62.

With respect to horizontal loads acting on the connection point, the structural connector of the present invention is capable of handling high horizontal loads. The horizontal load handling capability is attributable to the mating of the vertical, or substantially vertical, side walls 66 and 67 of the fixed support members 61 and 62 with the vertical, or substantially vertical, side walls 52 and 53 of the support notches 51 of the mating lugs 46 and 47. The use of vertical, or substantially vertical, side walls allows the horizontal loads imposed on the connection to be carried over a greater surface area. Specifically, unlike round, pin-type connectors, the side walls 66 and 67 of the fixed support members 61 and 62 are in contact with the side walls 52 and 53 of the support notches 51 along the entire length of the walls. Any horizontal forces acting on the connection will be spread out over the entire surface of the walls and, thus, the stresses placed on the connection point by these horizontal forces is reduced. Further, if significant horizontal forces are expected, the length of the side walls 66 and 67 of the fixed support members 61 and 62 and the length of the side walls 52 and 53 of the support notches 51 can be increased to provide an even greater area to handle such forces.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. A structural connector comprising:

a plurality of support plates each having a plurality of fixed support members extending therethrough, the fixed support members extending outwardly from both sides of the support plates and comprising side walls and contoured tops;

a mating lug assembly comprising a plurality of mating lug plates and a plurality of mating lugs attached to each mating lug plate, each mating lug having a support notch therein;

wherein the support notch of each mating lug comprises tapered guide surfaces at the entry point of the support notch, side walls, and a contoured top.

2. The structural connector of claim 1 wherein the side walls of each fixed support member are substantially vertical.

3. The structural connector of claim 1 wherein the side walls of the support notches of the mating lugs are substantially vertical.

4. The structural connector of claim 1 wherein a vertical load on the structural connector is carried by the mating of the contoured tops of the support notches with the contoured tops of the fixed support members.

5. The structural connector of claim 1 wherein a horizontal load on the structural connector is carried by the mating of the side walls of the support notches of the mating lugs with the side walls of the fixed support members.

6. The structural connector of claim 1 wherein the structural connector is used to connect a unitized equipment floor of a drilling rig to the substructure of the drilling rig.

7. A method of connecting components of a drilling rig comprising:

providing a first side box with a plurality of support plates attached thereto;

providing a second side box with a plurality of support plates attached thereto;

providing each support plate of the first side box and the second side box with a plurality of fixed support members extending therethrough, each fixed support member comprising side walls and a contoured top;

providing at least a portion of an equipment floor with a plurality of mating lug assemblies attached thereto, each mating lug assembly comprising a plurality of mating lug plates and a plurality of mating lugs attached to each mating lug plate;

providing each mating lug with a support notch, the support notch comprising tapered guide surfaces at the entry point of the support notch, side walls, and a contoured top;

positioning the first side box and the second side box;

positioning the equipment floor for connection to the first side box and the second side box by aligning the mating lugs of the mating lug assemblies with the fixed support members of the support plates;

guiding the fixed support members into engagement with the support notches of the mating lugs using the tapered guide surfaces of the support notches.

8. The method of claim 7 further comprising assembling components of the equipment floor to form a unitized equipment floor.

9. The method of claim 7 further comprising providing the fixed support members with substantially vertical side walls.

10. The method of claim 7 further comprising welding the mating lugs to the mating lug plates.

11. The method of claim 7 further comprising cutting the shape of the support notches into the mating lug plates.

12. A method of connecting components of a drilling rig comprising:

providing a first side box with a plurality of mating lug assemblies attached thereto, each mating lug assembly comprising a plurality of mating lug plates and a plurality of mating lugs attached to each mating lug plate;

providing a second side box with a plurality of mating lug assemblies attached thereto, each mating lug assembly comprising a plurality of mating lug plates and a plurality of mating lugs attached to each mating lug plate;

providing each mating lug with a support notch, the support notch comprising tapered guide surfaces at the entry point of the support notch, side walls, and a contoured top;

providing at least a portion of an equipment floor with a plurality of support plates attached thereto, each support plate having a plurality of fixed support members extending therethrough, each fixed support member comprising side walls and a contoured top;

positioning the first side box and the second side box;

positioning the equipment floor for connection to the first side box and the second side box by aligning the mating lugs of the mating lug assemblies with the fixed support members of the support plates;

guiding the fixed support members into engagement with the support notches of the mating lugs using the tapered guide surfaces of the support notches.

13. The method of claim 12 further comprising assembling components of the equipment floor to form a unitized equipment floor.

14. The method of claim 12 further comprising providing the fixed support members with substantially vertical side walls.

15. The method of claim 12 further comprising welding the mating lugs to the mating lug plates.

16. The method of claim 12 further comprising cutting the shape of the support notches into the mating lug plates.

* * * * *